US005845691A

United States Patent [19]

Gaines

[11] Patent Number: 5,845,691

[45] Date of Patent: Dec. 8, 1998

[54] VENETIAN BLINDS CONTROL SYSTEM

[76] Inventor: Vonciel Gaines, 3511 Doria La., Olympia Fields, Ill. 60461

[21] Appl. No.: 950,054

[22] Filed: Oct. 14, 1997

[51] Int. Cl.[6] ..... E06B 3/48

[52] U.S. Cl. ..... 160/115

[58] Field of Search ..... 160/115, 114, 160/113, 176.1 R, 173 R, 168.1 R, 177 R, 170 R

[56] References Cited

U.S. PATENT DOCUMENTS

| | | | |
|---|---|---|---|
| 2,117,953 | 5/1938 | Grau | 160/114 |
| 3,111,164 | 11/1963 | Lombard | 160/115 |
| 4,076,068 | 2/1978 | Archer et al. | 160/114 X |
| 4,621,672 | 11/1986 | Hsu | 160/115 |
| 4,708,188 | 11/1987 | Bytheway | 160/176.1 R X |
| 5,060,709 | 10/1991 | Simon | 160/176.1 R X |
| 5,119,868 | 6/1992 | Werner | 160/115 |
| 5,232,037 | 8/1993 | Fraser | 160/176.1 R X |
| 5,485,874 | 1/1996 | Whitmore | 160/115 |

*Primary Examiner*—David M. Purol

[57] ABSTRACT

The present invention relates to a control system for venetian blinds. Through the control system the upper half of the blinds can be rotated independent of the lower half and vice versa. The control system employs two rotatable dowels, a forwardly located dowel and a rearward dowel. Rotation of the forward dowel effects rotation of the upper set of venetian blinds, while rotation of the rearward dowel effects rotation of the lower set of venetian blinds. The rotation is made possible by two sets of drawstrings. A forwardly located set of drawstrings is attached to the forward edges of the upper set of blinds. The forward set of drawstrings is controlled by the forward dowel. A rearwardly located set of drawstrings is attached to the rearward edges of the lower set of blinds. The rearward set of drawstrings is controlled by the rearward dowel.

1 Claim, 2 Drawing Sheets

VENETIAN BLINDS CONTROL SYSTEM

BACKGROUND OF THE INVENTION

1. Field of the Invention

The present invention relates to a venetian blind control system and more particularly pertains to such a control system which allow for the control of the upper and lower halves of the blind.

2. Description of the Prior Art

The use of a venetian blinds is known in the prior art. More specifically, venetian blinds are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,119,868 to Werner discloes a venetian blind with a three position tilt adjustment. U.S. Pat. No. 4,621,672 discloses a mechanism for a window blind. U.S. Pat. No. 5,402,840 to Jortner discloses a venetian blind tilt divider. U.S. Pat. No. 4,940,070 to Warden discloses a bifold privacy miniblind. U.S. Pat. No. 5,121,783 to Nilsson discloses a window covering apparatus. Lastly, U.S. Design Pat. 353,503 to Belue discloses a venetian blind design.

In this respect, the venetian blind control system of the present invention substantially departs from the conventional concepts and designs of the prior art, and in so doing provides an apparatus primarily developed for the purpose of controling the upper and lower halves of the blinds independently of one another.

Therefore, it can be appreciated that there exists a continuing need for improved control systems for venetian blinds. In this regard, the present invention substantially fulfills this need.

SUMMARY OF THE INVENTION

In view of the foregoing disadvantages inherent in the known types of venetian blinds now present in the prior art, the present invention provides a control system with dual control rods. As such, the general purpose of the present invention, which will be described subsequently in greater detail, is to allow for more control over a set of venetian blinds.

To attain this, the present invention essentially comprises a control system for venetian blinds. Through the control system the upper half of the blinds can be rotated independent of the lower half and vice versa. The control system employs two rotatable dowels, a forwardly located dowel and a rearward dowel. Rotation of the forward dowel effects rotation of the upper set of venetian blinds, while rotation of the rearward dowel effects rotation fo the lower set of venetian blinds. The rotation is made possible by two sets of drawstrings. A forwardly located set of drawstrings is attached to the forward edges of the upper set of blinds. The forward set of drawstrings is controlled by the forward dowel. A rearwardly located set of drawstrings is attached to the rearward edges of the lower set of blinds. The rearward set of drawstrings is controlled by the rearward dowel.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved venetian blind operating system. The system includes a top frame having a first end, a second end and an intermediate extent therebetween. A rearward dowel is rotatably secured within the top frame, and the rearward dowel has a first end proximate to the first end of the frame and a second end proximate to the second end of the frame. A rearward gearbox is positioned upon the rearward dowel proximate to the first end of the dowel. The rearward gear box functions to convert substantially vertical rotation into the horizontal rotation of the rearward dowel. A first rearward spindle is secured upon the rearward dowel at the first end. An intermediate spindle is secured upon the rearward dowel intermediate the first and second ends. A third rearward spindle is secured upon the rearward dowel at the second end. A forward dowel is rotatably secured within the top frame. The forward dowel has a first end proximate to the first end of the frame and a second end proximate to the second end of the frame. A forward gearbox is positioned upon the forward dowel proximate to the second end of the dowel. The rearward gear box functions to convert substantially vertical rotation into the horizontal rotation of the rearward dowel. A first forward spindle is secured upon the forward dowel at the first end,and an intermediate spindle is secured upon the forward dowel intermediate the first and second ends. A third forward spindle is secured upon the forward dowel at the second end. An upper set of venetian blinds is controled by the system. The upper set of blinds has forward edges and rearward edges. A first forward drawstring has a lower end,and upper end and an intermediate extent therebetween. The upper end is secured to the first forward spindle. The intermediate extent is secured to the forward edges of the upper set of venetian blinds. An intermediate forward drawstring has a lower end, an upper end and an intermediate extent therebetween. The upper end is secured to the intermediate frward spindle, and the intermediate extent is secured to the forward edges of the upper set of venetian blinds. A third forward drawstring has a lower end, an upper end and an intermediate extent therebetween. The upper end is secured to the third forward spindle, and the intermediate extent is secured to the forward edges of the upper set of venetian blinds. A lower set of venetian blinds is also controlled by the system. The lower set of blinds has forward edges and rearward edges. A first rearward drawstring has a lower end,and upper end and an intermediate extent therebetween. The upper end is secured to the first rearward spindle,and the intermediate extent is secured to the rearward edges of the lower set of venetian blinds. An intermediate rearward drawstring has a lower end, an upper end and an intermediate extent therebetween. The upper end is secured to the intermediate rearward spindle, and the intermediate extent is secured to the rearwar edges of the lower set of venetian blinds. A third rearward drawstring has a lower end, an upper end and an intermediate extent therebetween. The upper end is secured to the third rearward spindle. The intermediate extent is secured to the rearward edges of the lower set of venetian blinds. An upper control rod is coupled to the forward gear box, and rotation of the upper control rod rotates the forward dowel and rotates the upper set of blinds.A lower control rod is coupled to the rearward gear box, with rotation of the upper control rod rotating the forward dowel and the rotating the lower set of blinds.

It is another object of the present invention to provide a venetian blinds control system with a forward set of drawstrings controlling the upper half of the blinds, and a rearward set of drawstrings controlling the lower half of the blinds.

It is a further object of the present invention to provide a control system of simplified construction.

An even further object of the present invention is to provide a venetian blinds control system which is susceptible of a low cost of manufacture with regard to both materials and labor, and which accordingly is then susceptible of low prices of sale to the consuming public, thereby making such venetian blinds economically available to the buying public.

Still yet another object of the present invention is to provide a venetian blinds control system which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
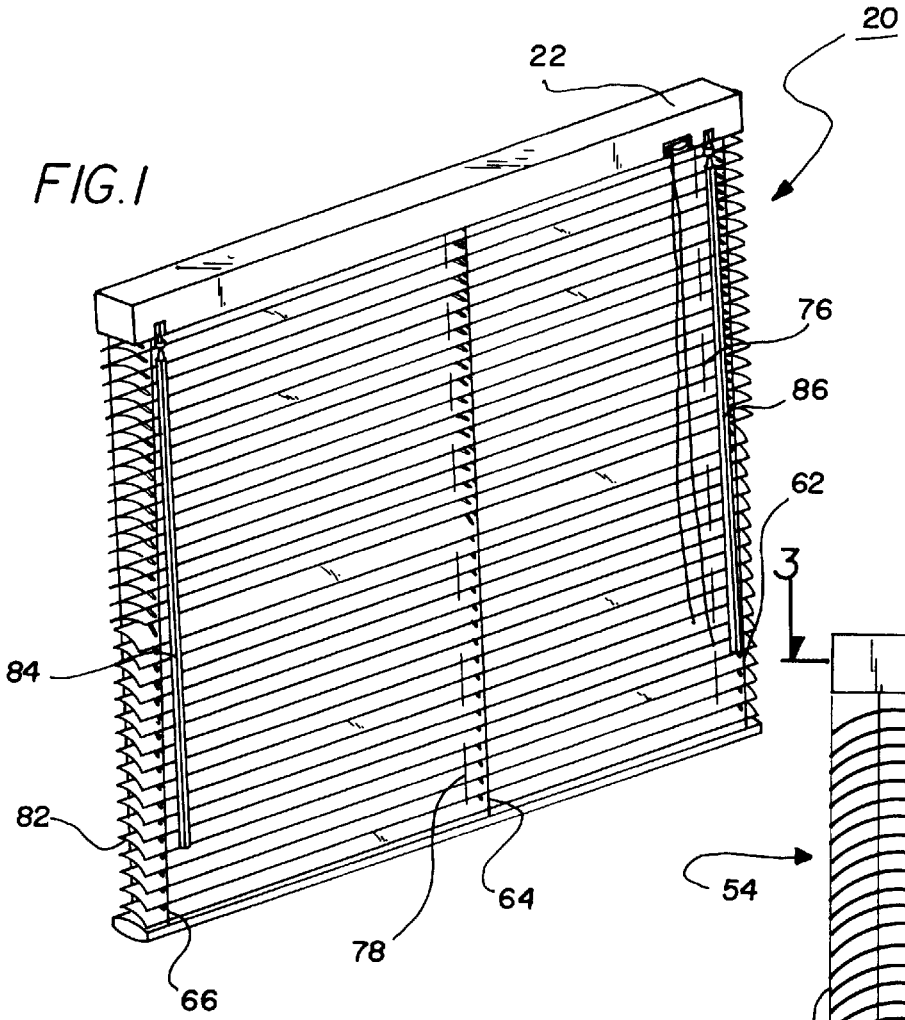
FIG. 1 is a perspective view of venetian blinds employing the control system of the present invention.

The present invention relates to a control system for venetian blinds. Through the control system the upper half of the blinds can be rotated independent of the lower half and vice versa. The control system employs two rotatable dowels, a forwardly located dowel and a rearward dowel. Rotation of the forward dowel effects rotation of the upper set of venetian blinds, while rotation of the rearward dowel effects rotation fo the lower set of venetian blinds. The rotation is made possible by two sets of drawstrings. A forwardly located set of drawstrings is attached to the forward edges of the upper set of blinds. The forward set of drawstrings is controlled by the forward dowel. A rearwardly located set of drawstrings is attached to the rearward edges of the lower set of blinds. The rearward set of drawstrings is controlled by the rearward dowel. The various components of the present invention, and the manner in which they interrelate, will be described in greater detail hereinafter.

The venetian blind operating system is designated generally by reference numeral 20.The system includes a top frame 22 defined by a first end 24, a second end 26 and an intermediate extent therebetween 28. A rearward dowel 32 is rotatably secured within this top frame 22. The rearward dowel 32 is defined by a first end proximate to the first end of the frame,and a second end proximate to the second end of the frame. A rearward gearbox 34 is positioned upon the rearward dowel 32 proximate to the first end of the dowel. This rearward gear box 34 functions to convert substantially vertical rotation into the horizontal rotation of the rearward dowel 32. A first rearward spindle 36 is secured upon the rearward dowel 32 at the first end,and an intermediate spindle 37 is secured upon the rearward dowel 32 intermediate the first and second ends. Additionally, a third rearward spindle 38 is secured upon the rearward dowel 32 at the second end.

A forward dowel 42 is rotatably secured within the top frame 22. This forward dowel 42 has a first end proximate to the first end of the frame 22, and a second end proximate to the second end of the frame 26. A forward gearbox 44 is positioned upon the forward dowel 42 proximate to the second end of the dowel. This forward gear box 44 functions to convert substantially vertical rotation into the horizontal rotation of the rearward dowel 32. A first forward spindle 46 is secured upon the forward dowel 42 at the first end,and an intermediate spindle 48 secured upon the forward dowel 42 intermediate the first and second ends. Additionaly, a third forward spindle 52 is secured upon the forward dowel 42 at the second end.

Figure 2:
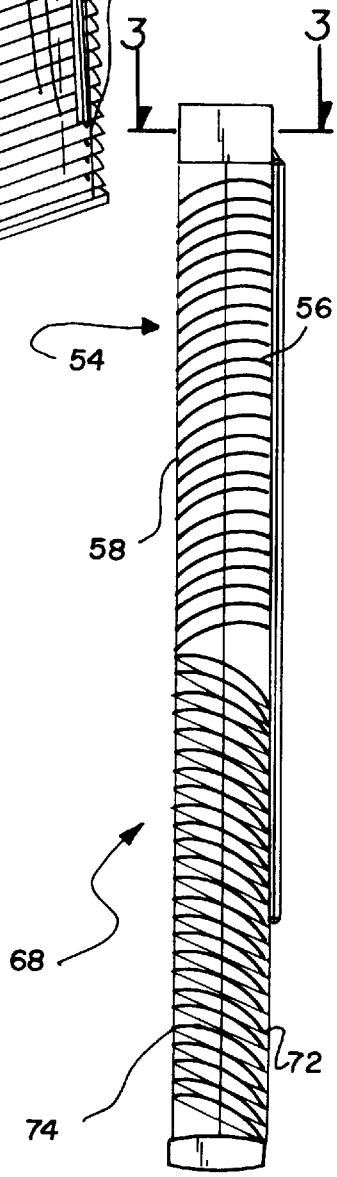
FIG. 2 is a side elevational view of the blinds of the present invention.
Figure 3:
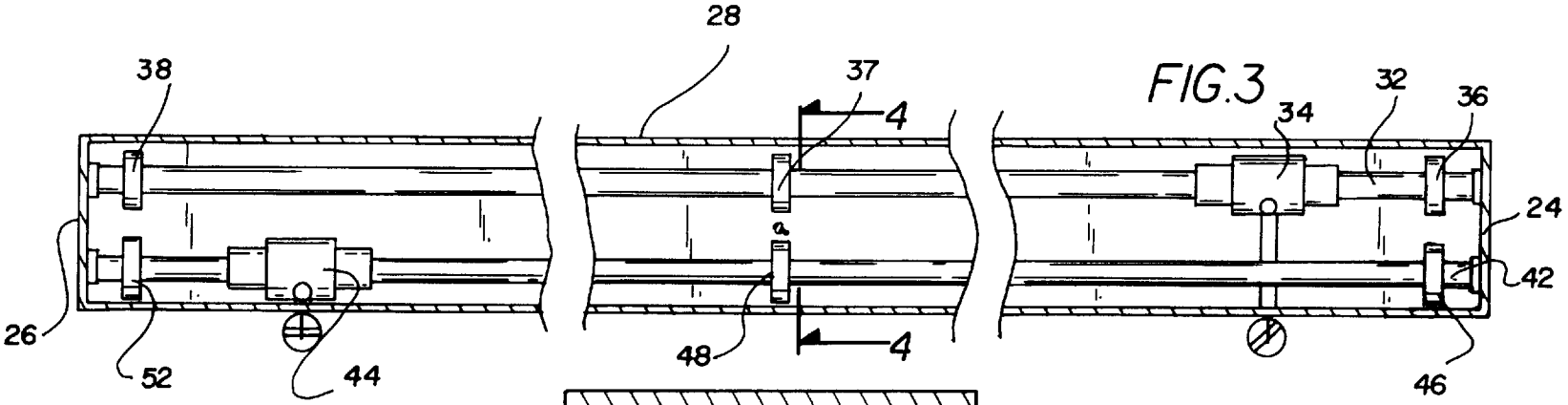
FIG. 3 is a view taken along line 3—3 of FIG. 2.
Figure 4:
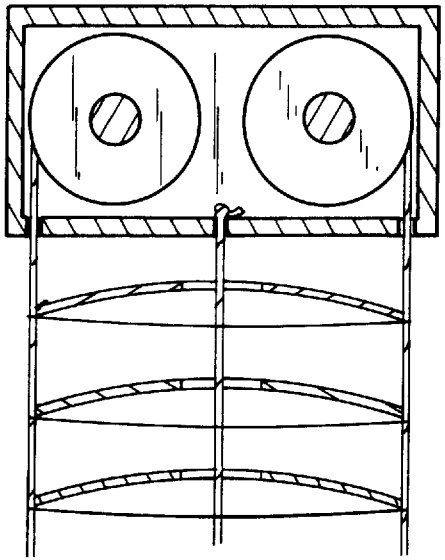
FIG. 4 is a view taken along line 4—4 of FIG. 3.

With reference to FIGS. 1 and 2 the upper set of venetian blinds 54 is illustrated. This upper set of blinds 54 has both forward edges 56 and rearward edges 58. A first forward drawstring 62 is employed by the system. This first forward drawstring 62 is defined by a lower end,and upper end and an intermediate extent therebetween. The upper end is secured to the first forward spindle 46, with the intermediate extent secured to the forward edges 56 of the upper set of venetian blinds 54. Additionally, an intermediate forward drawstring 64 is defined by a lower end, an upper end and an intermediate extent therebetween. The upper end is secured to the intermediate forward spindle 48,with the intermediate extent secured to the forward edges 56 of the upper set of venetian blinds 54. Lastly,a third forward drawstring 66 is defined by a lower end, an upper end and an intermediate extent therebetween. The upper end is secured to the third forward spindle 53, and the intermediate extent is secured to the forward edges 56 of the upper set of venetian blinds 54.

With continuing reference to FIGS. 1 and 2, the lower set of venetian blinds 68 is illustrated. The lower set of blinds 68 has forward edges 72 and rearward edges 74. The first rearward drawstring 76 has a lower end,and upper end and an intermediate extent therebetween. The upper end is secured to the first rearward spindle 36, with the intermediate extent secured to the rearward edges 74 of the lower set of venetian blinds 68. Additionally, an intermediate rearward drawstring 78 is defined by a lower end, an upper end and an intermediate extent therebetween. The upper end is secured to the intermediate rearward spindle 36, with the intermediate extent secured to the rearwar edges 74 of the lower set of venetian blinds 68. Lastly, a third rearward drawstring 82 is defined by a lower end, an upper end and an intermediate extent therebetween. The upper end is secured to the third rearward spindle 38, with the intermediate extent secured to the rearward edges 74 of the lower set of venetian blinds 68.

An upper control rod 84 is coupled to the forward gear box 44. Rotation of this upper control rod 84 rotates the forward dowel 42. This ,in turn, rotates the upper set of blinds 54. The lower control rod 86 is coupled to the rearward gear box 34. Rotation of the upper control rod 84 rotates the forward dowel 42 as well as the lower set of blinds 68.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A venetian blind operating system comprising in combination:

a top frame having a first end, a second end and an intermediate extent therebetween the top frame having a closed upper end;

a rearward dowel rotatably secured within the top frame extending between opposed side walls thereof, the rearward dowel having a first end proximate to the first end of the frame and a second end proximate to the second end of the frame, a rearward gearbox positioned upon the rearward dowel proximate to the first end of the dowel, the rearward gear box functioning to convert substantially vertical rotation into the horizontal rotation of the rearward dowel, a first rearward spindle secured upon the rearward dowel at the first end, an intermediate spindle secured upon the rearward dowel intermediate the first and second ends, a third rearward spindle secured upon the rearward dowel at the second end;

a forward dowel rotatably secured within the top frame extending between the opposed side walls thereof, the forward dowel being at the same height as the rearward dowel, the forward dowel having a first end proximate to the first end of the frame and a second end proximate to the second end of the frame, a forward gearbox positioned upon the forward dowel proximate to the second end of the dowel, the forward gear box functioning to convert substantially vertical rotation into the horizontal rotation of the rearward dowel, a first forward spindle secured upon the forward dowel at the first end, an intermediate spindle secured upon the forward dowel intermediate the first and second ends, a third forward spindle secured upon the forward dowel at the second end;

whereby the rearward dowel and the forward dowel having equal lengths and being interchangeable with respect to one another;

an upper set of venetian blinds, the upper set of blinds having forward edges and rearward edges;

a first forward drawstring having a lower end, and upper end and an intermediate extent therebetween, the upper end secured to the first forward spindle, the intermediate extent secured to the forward edges of the upper set of venetian blinds;

an intermediate forward drawstring having a lower end, an upper end and an intermediate extent therebetween, the upper end secured to the intermediate forward spindle, the intermediate extent secured to the forward edges of the upper set of venetian blinds;

a third forward drawstring having a lower end, an upper end and an intermediate extent therebetween, the upper end secured to the third forward spindle, the intermediate extent secured to the forward edges of the upper set of venetian blinds;

a lower set of venetian blinds, the lower set of blinds having forward edges and rearward edges;

a first rearward drawstring having a lower end, and upper end and an intermediate extent therebetween, the upper end secured to the first rearward spindle, the intermediate extent secured to the rearward edges of the lower set of venetian blinds;

an intermediate rearward drawstring having a lower end, an upper end and an intermediate extent therebetween, the upper end secured to the intermediate rearward spindle, the intermediate extent secured to the rearward edges of the lower set of venetian blinds;

a third rearward drawstring having a lower end, an upper end and an intermediate extent therebetween, the upper end secured to the third rearward spindle, the intermediate extent secured to the rearward edges of the lower set of venetian blinds;

an upper control rod coupled to the forward gear box, rotation of the upper control rod rotating the forward dowel and rotating the upper set of blinds;

a lower control rod coupled to the rearward gear box, rotation of the upper control rod rotating the forward dowel and the rotating the lower set of blinds.

* * * * *